US008713735B1

(12) United States Patent
Pelton

(10) Patent No.: US 8,713,735 B1
(45) Date of Patent: May 6, 2014

(54) COMPACT SURVIVAL TOOL

(75) Inventor: Robert Young Pelton, Bonsall, CA (US)

(73) Assignee: DPX Ventures Limited, Ras Al Khaimah (AE)

( * ) Notice: Subject to any disclaimer, the term of this patent is extended or adjusted under 35 U.S.C. 154(b) by 265 days.

(21) Appl. No.: 13/312,968

(22) Filed: Dec. 6, 2011

(51) Int. Cl.
*B25F 1/00* (2006.01)
*B67B 7/44* (2006.01)
*B26B 27/00* (2006.01)

(52) U.S. Cl.
USPC ..... 7/138; 7/156; 7/158

(58) Field of Classification Search
USPC ..... D8/17–20, 105; 7/138, 142, 151, 156, 7/158
See application file for complete search history.

(56) References Cited

U.S. PATENT DOCUMENTS

| | | | | | |
|---|---|---|---|---|---|
| 1,388,979 | A | * | 8/1921 | Stewart et al. | 81/124.1 |
| D59,396 | S | * | 10/1921 | Williams | D8/17 |
| 1,455,621 | A | | 5/1923 | Joyner | |
| 2,315,898 | A | | 4/1943 | Krilow | |
| D141,321 | S | | 5/1945 | Gallagher | |
| 2,440,485 | A | | 4/1948 | Ranseen | |
| D169,490 | S | | 5/1953 | Hug | |
| D169,797 | S | | 6/1953 | Wallace | |
| 2,951,482 | A | | 9/1960 | Sullivan | |
| D224,388 | S | | 7/1972 | Wood | |
| 3,760,438 | A | | 9/1973 | White | |
| D230,696 | S | | 3/1974 | Evrell et al. | |
| D245,830 | S | | 9/1977 | DE Gross | |
| D257,383 | S | * | 10/1980 | Davenport | D8/17 |
| D266,479 | S | * | 10/1982 | Hayakawa | D8/17 |
| 4,363,147 | A | | 12/1982 | Deweese | |
| 4,442,559 | A | | 4/1984 | Collins | |
| 4,553,279 | A | | 11/1985 | Gassew et al. | |
| 4,578,864 | A | | 4/1986 | Hoffman | |
| 4,622,707 | A | | 11/1986 | Finn | |
| D288,895 | S | | 3/1987 | Sarnoff et al. | |
| 4,817,221 | A | | 4/1989 | Ryan | |
| 4,821,356 | A | | 4/1989 | Finn | |
| 4,905,547 | A | * | 3/1990 | Nigrelli | 81/176.15 |
| D308,009 | S | | 5/1990 | Evrell | |
| 5,259,281 | A | | 11/1993 | Burke | |
| D369,287 | S | | 4/1996 | Seber et al. | |
| 5,511,310 | A | | 4/1996 | Sessions et al. | |

(Continued)

FOREIGN PATENT DOCUMENTS

| | | |
|---|---|---|
| DE | 10130178 | 1/2003 |
| DE | 202009001850 | 12/2009 |

OTHER PUBLICATIONS

Blackwater Aculus Limited Edition Knife. Http://www.dpxgear.com/shop/aculus-coming-soon.html, Jun. 2, 2013.

(Continued)

*Primary Examiner* — Hadi Shakeri
(74) *Attorney, Agent, or Firm* — Arc IP Law, PC; Joseph J. Mayo

(57) ABSTRACT

Compact survival tool made for use in hostile environments that may include a spanner wrench, a castellated or slotted nut wrench, one or more hexagon nut wrenches each optionally having a threaded port to hold threaded accessories or for use as lashing points, bottle opener, cutting edge and/or wire strippers optionally formed in jimping, a button compass port and semi-circular faceted square/hex wrench or any combination thereof.

19 Claims, 7 Drawing Sheets

(56) References Cited

U.S. PATENT DOCUMENTS

| | | | | |
|---|---|---|---|---|
| D371,289 | S | | 7/1996 | Huang |
| D371,820 | S | | 7/1996 | Thompson |
| 5,596,808 | A | | 1/1997 | Lake et al. |
| 5,642,567 | A | | 7/1997 | Lin |
| 5,657,543 | A | | 8/1997 | Collins |
| D383,370 | S | | 9/1997 | Chen et al. |
| D385,471 | S | | 10/1997 | Seber et al. |
| 5,727,319 | A | | 3/1998 | Myerchin et al. |
| 5,727,325 | A | | 3/1998 | Mussell |
| D393,405 | S | | 4/1998 | Seber et al. |
| D398,211 | S | | 9/1998 | Howard |
| D400,412 | S | * | 11/1998 | Gold ..... D8/20 |
| 6,009,581 | A | | 1/2000 | Davis et al. |
| 6,009,582 | A | | 1/2000 | Harrison et al. |
| 6,009,584 | A | | 1/2000 | Padden |
| D422,669 | S | | 4/2000 | Elishewitz |
| D425,389 | S | | 5/2000 | Elishewitz |
| 6,085,620 | A | | 7/2000 | Anderson et al. |
| D435,409 | S | | 12/2000 | Roberts |
| D442,461 | S | | 5/2001 | Glesser |
| D446,571 | S | | 8/2001 | Frazer |
| 6,318,218 | B1 | | 11/2001 | Anderson et al. |
| D452,123 | S | | 12/2001 | Kelleghan |
| 6,347,875 | B1 | | 2/2002 | Painsith |
| D473,917 | S | | 4/2003 | Carter |
| 6,574,816 | B2 | | 6/2003 | Yu Chen |
| D479,970 | S | | 9/2003 | Hutchinson |
| 6,782,576 | B1 | | 8/2004 | Valencic et al. |
| D496,425 | S | | 9/2004 | Carter |
| D497,531 | S | | 10/2004 | Carter |
| D508,194 | S | | 8/2005 | Carter |
| 6,957,466 | B2 | | 10/2005 | Rivera |
| D515,654 | S | | 2/2006 | Trbovich, Jr. |
| D516,394 | S | * | 3/2006 | Chen ..... D8/19 |
| D519,185 | S | | 4/2006 | Carter |
| D520,825 | S | | 5/2006 | Kelleghan |
| D523,317 | S | | 6/2006 | Ryan et al. |
| D527,788 | S | | 9/2006 | Kellgren |
| D536,593 | S | | 2/2007 | Fraga |
| D553,467 | S | | 10/2007 | Ryan |
| D553,468 | S | | 10/2007 | Freeman |
| 7,302,760 | B2 | | 12/2007 | Lake |
| D563,755 | S | | 3/2008 | Wu |
| 7,337,486 | B2 | | 3/2008 | Tsuda et al. |
| 7,360,267 | B2 | | 4/2008 | Quenzi |
| 7,415,745 | B2 | | 8/2008 | Rivera |
| D599,640 | S | | 9/2009 | Yang-Fu |
| D599,641 | S | | 9/2009 | Yang-Fu |
| D600,090 | S | | 9/2009 | Yang-Fu |
| D609,992 | S | | 2/2010 | Delaney |
| 7,676,932 | B2 | | 3/2010 | Grice et al. |
| D614,933 | S | | 5/2010 | Freeman |
| D624,386 | S | | 9/2010 | van Deursen |
| D632,154 | S | | 2/2011 | Yang-Fu |
| D634,174 | S | | 3/2011 | Ryan et al. |
| 7,913,398 | B2 | | 3/2011 | Chu |
| D639,632 | S | | 6/2011 | Freeman et al. |
| D642,888 | S | | 8/2011 | Port et al. |
| D653,520 | S | | 2/2012 | Chang |
| D654,343 | S | | 2/2012 | Wu |
| D672,841 | S | | 12/2012 | Pelton |
| D672,842 | S | | 12/2012 | Pelton |
| D677,551 | S | | 3/2013 | Pelton |
| D679,975 | S | | 4/2013 | Pelton |
| 8,464,382 | B2 | | 6/2013 | Chu |
| 2006/0027645 | A1 | | 2/2006 | Granick |
| 2007/0245497 | A1 | | 10/2007 | Tsuda et al. |
| 2008/0222895 | A1 | | 9/2008 | Marfione et al. |
| 2008/0271257 | A1 | | 11/2008 | Frazer |
| 2010/0299933 | A1 | | 12/2010 | Vellekamp |
| 2012/0017443 | A1 | | 1/2012 | Hao |

OTHER PUBLICATIONS

CRKT Columbia River Knife and Tool's Exitool 9030 Multi Tool, retrieved from http://www.amazon.com/Columbia-River-Knife-Exitool-9030/dp/B00301V8TG on Jul. 24, 2012, 6 pages.

Boker Plus Credit Card Knife 2-1/4" Blade, retrieved from http://www.Knifecenter.com on Jul. 24, 2012, 2 pages.

Extended European Patent Search, dated Mar. 15, 2013, 5 pages.

The Original Dog Tag Knife, Titanium Blade, Black Rubber Frame, retrieved from http://www.knifeworks.com/theoriginaldogtagknifetitaniumblade.aspx on Jul. 24, 2012, 4 pages.

Iain Sinclair, CardSharp 2, retrieved from http://iainsinclair.com/products.php on Jul. 24, 2012, 1 page.

SE MT908 11 Function Credit Card Size Survival Pocket Tool, retrieved from http://www.amazon.com/SE-MT908-Function-Credit-Survival/dp/B000Q06L14 on Jul. 24, 2012, 6 pages.

ICE Companion with Lens/Compass—Translucent, retrieved from http://www.sogshopping.com/tools/icc1-12.html?SID=pp1bedicbg7qm82okgt77lacd6 on Jul. 24, 2012, 1 page.

Survival Card w/ Fire Starter/Compass—Charcoal, retrieved from http://www.toollogic.com/tools/svc1-38.html on Jul. 24, 2012, 1 page.

DPx HEST 2.0 Knife Survival Blade, http://www.bladehq.com/item--ESEE-DPx_HEST-Folder--6996, downloaded Sep. 26, 2012.

Sheffield Moab Folding Rescue Knife, http://www.autogeek,net/sheffield-rescue-knife.html, downloaded Sep. 27, 2012.

Ontario Hest Original Fixed Blade. Downloaded from http://www.sears.com/ontario-hest-origina-fixed-blade/p-SPM6596962201?prdNo=2&bl . . . on Nov. 16, 2012.

"Microtech Troodon Double Edge OTF Knife, Beadblast Plain Edge, 138-7" BladeOps, LLC, 2 pages, retrieved on Feb. 23, 2012.

CRKT "ExiTool—Designed by Russ Kommer", Columbia River Knife & Tool Inc., 2 pages, retrieved on Feb. 23, 2012.

* cited by examiner

FIGURE 2
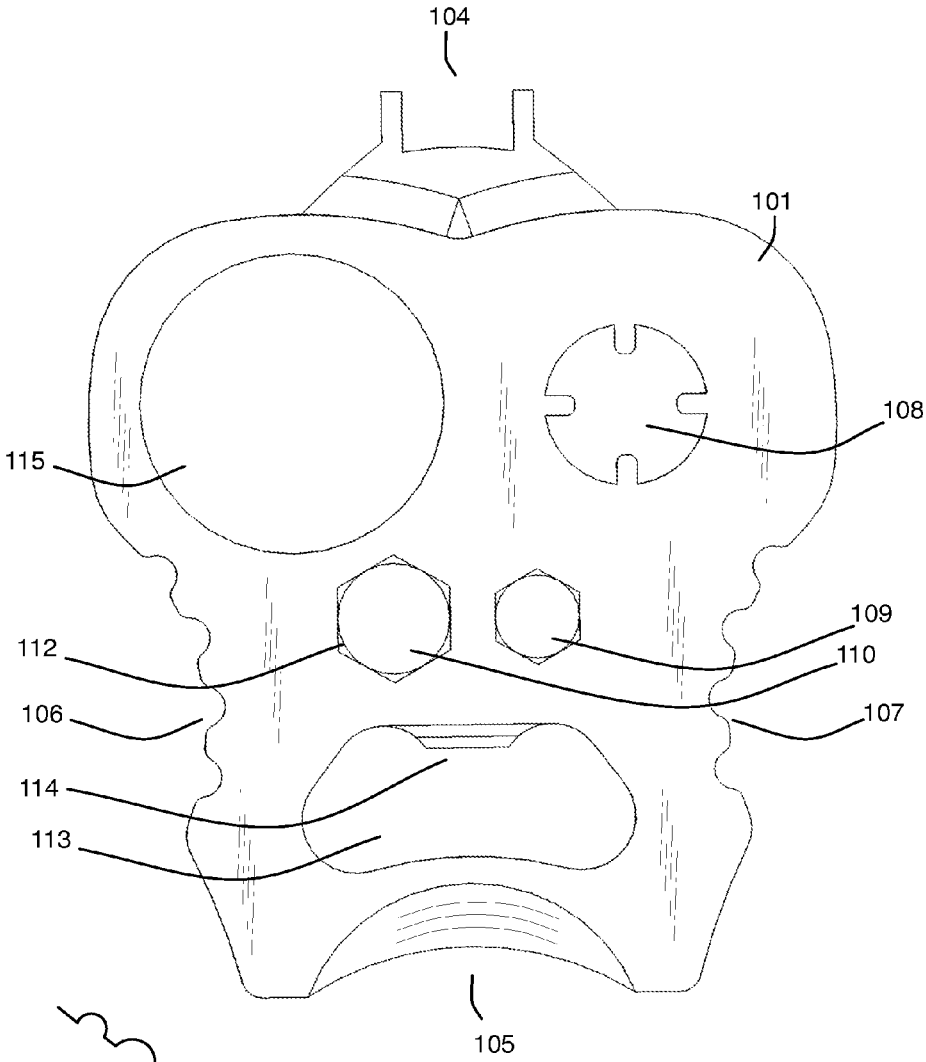
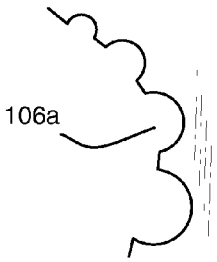
FIGURE 2A

COMPACT SURVIVAL TOOL

BACKGROUND OF THE INVENTION

1. Field of the Invention

One or more embodiments of the invention are related to the field of survival tools. More particularly, but not by way of limitation, embodiments enable a compact survival tool made for use in hostile environments that may include a spanner wrench, a castellated or slotted nut wrench or screwdriver, one or more holes or hexagon nut wrenches each optionally having a threaded port to hold threaded accessories or for use as lashing points, a bottle opener, a cutting edge and/or wire strippers optionally formed in jimping, a button compass port and a semi-circular faceted square/hex wrench or any combination thereof.

2. Description of the Related Art

Survival tools exist in variety of shapes and sizes. Many survival tools emphasize a knife portion, others emphasize pliers or an axe portion. Some of these types of tools include multiple functions and are known as multi-purpose or multi-function tools. Each of these types of tools look most like the originating design, but with added components.

Survival tools that emphasize a knife portion include knives with multiple functions generally utilize multiple blades, some of which are configured as screw drivers, saws, scissors, etc. These tools are modified knives and hence utilize a frame and handle area with folding elements. Knives specifically marketed as survival knives are generally fixed blade knives that evolved from hunting knives during World War II and the Viet Nam war to include serrations on the top portion of the knife blade. The serrations could be used to cut through the fuselage of aircraft to rescue crewmen for example.

Modern survival knives are limited in the number of functions they provide since the number of elements utilized to create a survival knife is limited to a blade, optionally with serrations and a handle. Improvements to survival knives include the addition of a storage area for example. These types of tools are generally not stored in a flat or small area since they are thick based on the width and number of blades/tools that are held in the frame.

Survival tools that emphasize pliers include LEATHERMAN® and other multi-tool devices that include a pair of pliers in the handles of which are knife blades, screw drivers, files, etc. These tools are generally relatively heavy and not possible to store in a flat area for example.

Survival tools that emphasize an axe generally provide large internal holes for fingers and hands so that the axe may be gripped from inside the tool body, thereby making the overall size of the axe too large to store in a small area. This allows for use of the axe as a hand axe, or for cutting or scraping.

Survival tools are also known to exist in credit card format, but these tools are generally very thin and have cutting edges or sawing edges on two consecutive sides, therefore making it impossible to grip any two opposing sides of the apparatus to use another side of the tool. In addition, known credit card size survival tools are so thin that they cannot be gripped on opposing sides without potentially cutting ones hands since the metal is so thin, even if it was not sharpened. For example, known credit card sized multi-function devices do not include grips on opposing sides of the tool body. In addition, even if they did the tool body is not thick enough to provide a usable depth between the two opposing sides of the apparatus to make for a good grip. Furthermore, there are no known credit card apparatus that employ jimping on opposing sides so as to provide a secure grip in wet conditions for example.

In minimalistic survival scenarios, carrying a multitude of tools is not possible. In such hostile environments, life may depend on having a survival tool that is robust and capable of performing multiple functions, and which may be packed in a small space or hidden. For at least the limitations described above there is a need for a compact survival tool.

BRIEF SUMMARY OF THE INVENTION

One or more embodiments described in the specification are related to a compact survival tool. Embodiments include a tool body having a top face that is substantially flat, a bottom face that is substantially flat wherein the bottom face is on an opposite side of the tool body with respect to the top face. Embodiments also include a side portion, known as the "tool side" herein, that couples the top face and the bottom face together and otherwise provides for a thick enough depth to grip both sides of the apparatus using the tool side as well as the top and bottom faces. Based on the size and shape of the apparatus, various embodiments of the invention may implement a combination of tools in a compact and rugged implementation that can be relied upon in hazardous environments as is described herein.

One or more embodiments of the invention include a spanner wrench, a cutting edge, grips on opposing sides of the apparatus along with holes in the tool body in the form of a castellated or slotted nut wrench and lashing point(s). The cutting edge(s) may be in the form of a straight or curved cutting edge that extends at an angle inwardly from the bottom face to the top face along an edge of the tool side. These cutting edges may be in the form of a straight knife-edge, wire stripper or smaller curved cutting edge and/or larger chisel style rounded cutting edge. Any other type of cutting edge may be utilized in an embodiment of the invention in keeping with the spirit of the invention.

Embodiments include a first grip and a second grip on opposite sides of the tool side. This allows for greater control in wet environments for example and also enables a larger gripping force on opposing sides of the apparatus based on the thickness of the tool side, which is generally thicker for example than known credit card sized tools. Embodiments of the invention also may include a castellated or slotted nut wrench indented into the top face of the tool body, and at least one hole between the top face and the bottom face configured as lashing point. Embodiments that employ a spanner wrench may be utilized with other survival equipment that provides hidden spaces for storage wherein the hidden spaces are screwed on with spanner nuts that provide no other way to unscrew them. The hidden spaces may be utilized for "get out of jail money", matches, fishhooks, etc., or any other item. Many third world countries or other hazardous environments do not have access to spanner wrenches and therefore may not be able to access the hidden contents stored in areas secured by this type of bolt head.

In at least one embodiment of the invention, the first grip or the second grip or both may include flat surfaces, knurled surfaces or may include "jimping". Jimping is a type of frictional element that includes use of notches cut into a tool to improve finger grip, by effectively increasing the coefficient of static friction. One or more embodiments of the invention include jimping with notches of varying size. For example the jimping may be configured as two or more indentations of different size configured to grip wire insulation of different gauge to enable translation movement of the tool body to remove the wire insulation.

In one or more embodiments of the invention, the tool body further includes a semi-circular indentation with a straight section configured to engage a square or hexagonal nut on one edge thereof. This type of hole provides an element for turning a square or hexagonal nut by placing the apparatus over the nut, engaging the flat side of the semi-circular hole with the size of the nut and turning the apparatus. Embodiments of the invention may also in combination or in the alternative thereto include a hexagonal indentation in the hole(s) that is/are configured to engage a hex nut to enable rotation of hex nut. The hexagonal indentation may also include a stop or ledge or threaded portion to engage a bolt or glass breaker or any other threaded item.

As one skilled in the art will appreciate, two or more hex nut engagement elements of different sizes may be implemented in the tool body depending on the desired application. For embodiments of the invention that have a semi-circular or hex shaped indentation, the respective indentation may include a circular section that is threaded to enable storage of threaded elements. For example, threaded accessories such as glass breakers, i.e., conical high strength points that are coupled with other tools may be screwed into the hole and stored. The circular area may reside near the bottom face for example to provide a stop ledge that prevents the nut from travelling through the tool body while turning the nut.

Embodiments of the invention may further include a bottle opener formed in the tool body as a hole in the tool body large enough to span a depth of a bottle cap and wherein the hole optionally comprises a bottle cap engagement lip in an inner portion of the hole. Other embodiments of the invention may implement a bottle opener with a gap in the tool side as opposed to a hole for example.

At least one embodiment of the invention may also include a button compass port in the tool body that configured to couple with a button compass. In one or more embodiments, the button compass port may for example be sized to accommodate a standard sized button compass. Standard sizes include 15 mm and 20 mm button compasses for example. Hence in one or more embodiments the button compass port may be implemented with a hole have a dimension of a standard size, or slightly under to provide a snug fit. Other embodiments of the invention may be provided with a threaded hole to accommodate a threaded compass for example. Any other coupling technique may be utilized to couple a compass to an embodiment of the invention, as one skilled in the art will appreciate.

Embodiments of the invention may be constructed in any size, in one embodiment the tool side is at least 4 mm deep and the top face and the bottom face do not exceed 50 mm in height or width. Embodiments may be made from stainless steel, titanium or any other material or composite material depending on the intended environment in which the apparatus is to be utilized.

BRIEF DESCRIPTION OF THE DRAWINGS

The above and other aspects, features and advantages of the invention will be more apparent from the following more particular description thereof, presented in conjunction with the following drawings wherein:

FIG. 2 illustrates a front view of an embodiment of the invention, and FIG. 2A illustrates jimping with notches of varying size according to one or more embodiments of the invention.

DETAILED DESCRIPTION OF THE INVENTION

A compact survival tool will now be described. In the following exemplary description numerous specific details are set forth in order to provide a more thorough understanding of embodiments of the invention. It will be apparent, however, to an artisan of ordinary skill that the invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
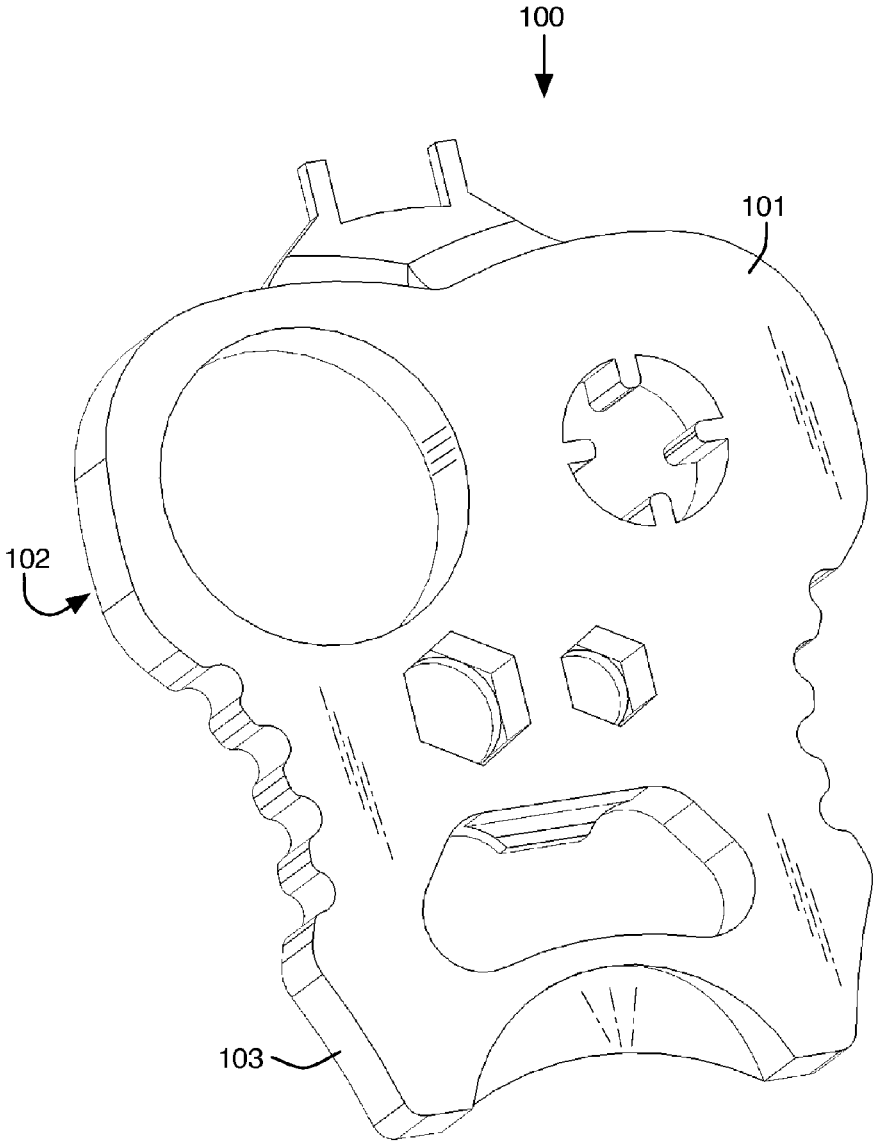
FIG. 1 illustrates a perspective view of an embodiment of the invention.

FIG. 1 illustrates a perspective view of an embodiment of the invention. Embodiments include tool body 100 having top face 101 that is substantially flat, bottom face 102 (also see FIG. 3) that is substantially flat wherein the bottom face is on an opposite side of the tool body with respect to the top face. Embodiments also include a side portion, known as "tool side" 103 herein, that couples top face 101 and bottom face 102 together and otherwise provides for a thick enough depth to grip both sides of the apparatus. The thickness of the tool side in one or more embodiments enables for a more secure and forceful grip that is useful in hostile environments or dangerous environments where security of grip of an embodiment of the tool may be life saving for example.

FIG. 2 illustrates a front view of an embodiment of the invention. One or more embodiments of the invention include spanner wrench 104, at least one cutting edge such as cutting edge 105, grips 106 and 107 on opposing sides of tool body 100 along with holes in the tool body in the form of castellated or slotted nut wrench 108 and lashing point(s) or hexagonal nut wrenches 109 and 110 for example. Spanner wrench 104 may be replaced with, or utilized as a screwdriver in one or more embodiments. In other embodiments a screwdriver may be formed into any edge of the apparatus as desired. The cutting edge(s) may be in the form of a straight cutting edge (see FIGS. 10 and 11) or curved cutting edge as shown (also see FIGS. 8 and 9 for small curved cutting edges 105*a*) that extends at an angle inwardly from the bottom face to the top face along an edge of tool side 103. Cutting edges compatible with embodiments may be in the form of a straight knife-edge, wire stripper or smaller curved cutting edge and/or larger chisel style rounded cutting edge or any combination thereof. Any other type of cutting edge may be utilized in an embodiment of the invention in keeping with the spirit of the invention.

Embodiments include first grip 106 and second grip 107 on opposite sides of tool side 103. Grips 106 and 107 may be flat or knurled or may include jimping. Jimping is a type of frictional element that includes use of notches cut into a tool to improve finger grip, by effectively increasing the coefficient of static friction. Jimping allows for greater control in wet environments for example and also enables a larger gripping force on opposing sides of the apparatus based on the thickness of the tool side, which is generally thicker for example than known credit card sized tools. One or more embodiments of the invention include jimping with notches of varying size as is shown in FIG. 2A as variable sized jimping 106*a*. For example the jimping may be configured as two or more indentations of different size configured to grip wire insulation of different gauge to enable translation movement of the tool body to remove the wire insulation.

Embodiments of the invention also may include any other type of wrench in place of castellated or slotted nut wrench 108. This wrench as all other wrenches described herein may pass entirely through tool body 100, or partially in order to form a stopping point, for example as shown by circular section 112. All holes in tool body 100 may be utilized as lashing points. Embodiments that employ a spanner wrench may optionally be utilized with other survival equipment that provides hidden spaces for storage wherein the hidden spaces are screwed on with spanner nuts that provide no other way to unscrew them, e.g., a regular screw driver will not turn spanner nuts having two holes on outer portions of the head without a gap between them for a regular screwdriver to operate. The hidden spaces may be utilized for "get out of jail money", matches, fishhooks, etc., or any other item. The spanner wrench may also be utilized to set a torsion setting on a folding knife or for any other purpose.

Figure 10:
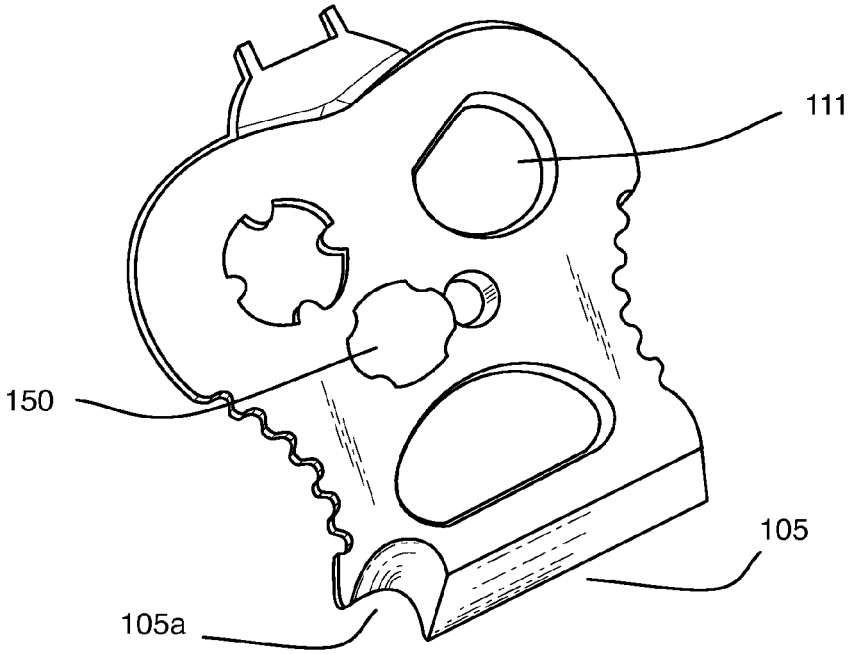
FIG. 10 illustrates a perspective view of a second embodiment of the invention.

In one or more embodiments of the invention, the tool body further includes semi-circular indentation 111 (as is shown in FIG. 10) with a straight section configured to engage a square or hexagonal nut on one edge thereof. This type of hole provides an element for turning a square or hexagonal nut by placing the apparatus over the nut, engaging the flat side of the semi-circular hole with the size of the nut and turning the apparatus. Embodiments of the invention may also in combination or in the alternative thereto include a hexagonal indentation in the at least one hole 109, 110 that is configured to engage a hex nut to enable rotation of hex nut. As one skilled in the art will appreciate, two or more hex nut engagement elements of different sizes may be implemented in the tool body depending on the desired application as is shown. In other embodiments, one semi-circular with straight section and one hexagonal or other shape hole may be utilized in combination. For embodiments of the invention that have a semi-circular or hex shaped indentation, the respective indentation may include a circular section 112 that is optionally threaded to enable storage of threaded elements. For example, threaded accessories such as glass breakers, i.e., conical high strength points that are coupled with other tools may be screwed into the hole and stored. In other embodiments the circular area may be unthreaded or simply allow a component to snap into the hole to be held in place for example with a spring loaded ball bearing, by magnet, or by friction. Any other method of coupling an accessory to a hole through tool body 100 is in keeping with the spirit of the invention.

Embodiments of the invention may further include bottle opener 113 formed in the tool body as a gap (as per FIG. 11) or hole in the tool body large enough to span a depth of a bottle cap and wherein the hole optionally includes bottle cap engagement lip 114 in an inner portion of the hole. Bottle cap engagement lip 114 provides a point to place under the cap to facilitate removal thereof.

At least one embodiment of the invention may also include button compass port 115 in tool body 100 that configured to couple with a button compass. In one or more embodiments, the button compass port may for example be sized to accommodate a standard sized button compass. Standard sizes include 15 mm and 20 mm button compasses for example. Hence in one or more embodiments the button compass port may be implemented with a hole have a dimension of a standard size, or slightly under to provide a snug fit. Other embodiments of the invention may be provided with a threaded hole to accommodate a threaded compass for example. Any other coupling technique may be utilized to couple a compass to an embodiment of the invention, as one skilled in the art will appreciate.

Embodiments of the invention may be constructed in any size, in one embodiment the tool side is at least 4 mm deep and the top face and the bottom face do not exceed 50 mm in height or width. Embodiments may be made from titanium or any other material depending on the desired environment in which the apparatus is to be utilized.

Figure 3:
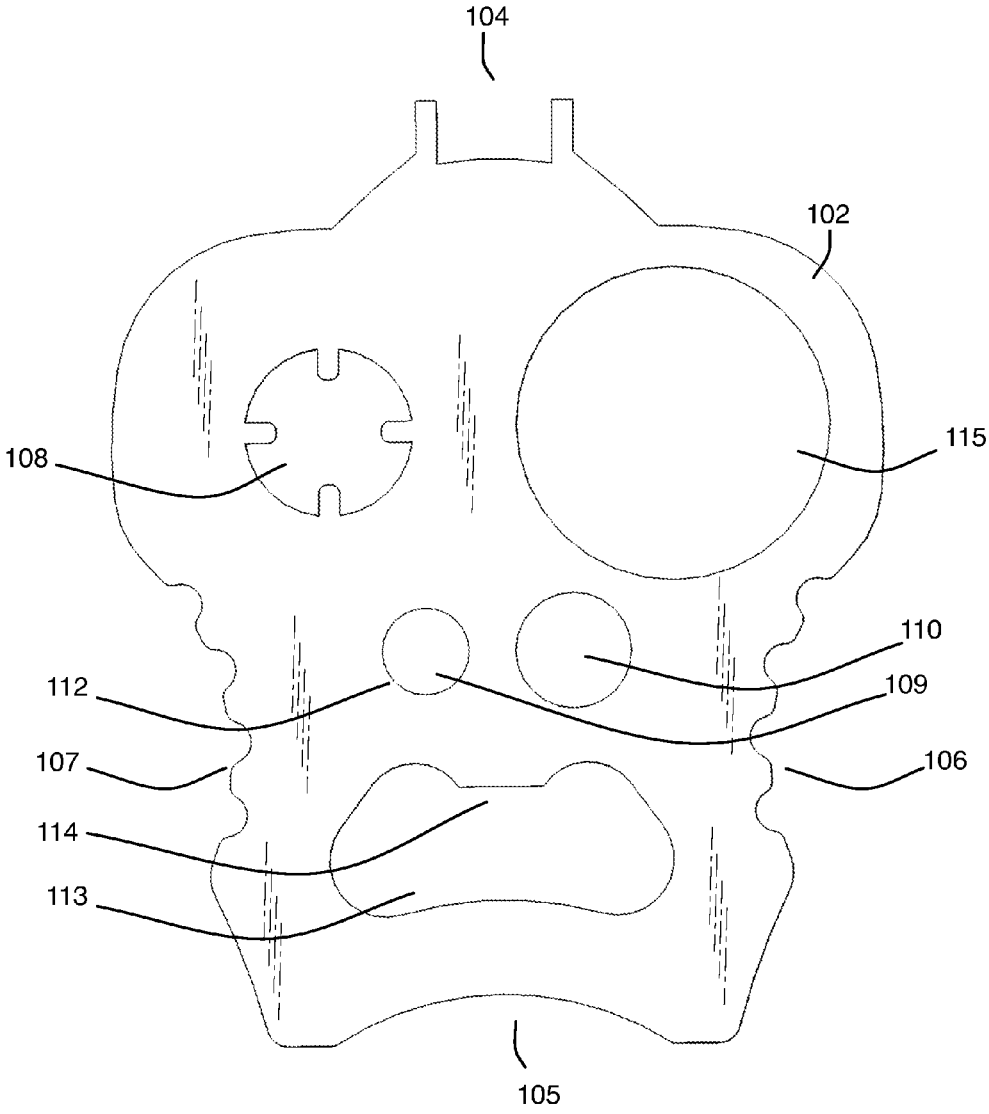
FIG. 3 illustrates a back view of an embodiment of the invention.

FIG. 3 illustrates a back view of an embodiment of the invention. For ease of construction, one or more embodiments may be pressed or molded wherein the concave portions lie on top face 101 while bottom face 102 has convex or flat portions. This is not required however and any manufacturing technique may be utilized. As shown in FIG. 2, holes 109 and 110 are hexagonal on top face 101 and circular on bottom face 102 as shown in FIG. 3 as they effectively form the bottom portions of circular sections 112 as shown in FIG. 2. As previously stated, the circular sections as mentioned above may or may not be threaded to provide for storage of threaded accessories. In one or more embodiments of the invention, circular sections 112 are not implemented and hence the shape of the particular hole, e.g., hexagonal, extend entirely through the tool body. In other embodiments, a stop pin or any other type of element that extends radially inward to prevent a nut from passing entirely through the tool body while turning the nut may be implemented.

Figure 4:
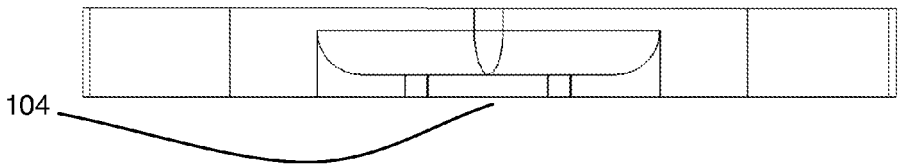
FIG. 4 illustrates a top view of an embodiment of the invention.

FIG. 4 illustrates a top view of an embodiment of the invention. Spanner wrench 104 is shown pointing out of the page. As one skilled in the art will appreciate any other type of implement may be utilized in place of a spanner wrench including any type of screwdriver, drill, pick, or any other type of tool depending on the intended environment in which the tool is to be utilized.

Figure 5:
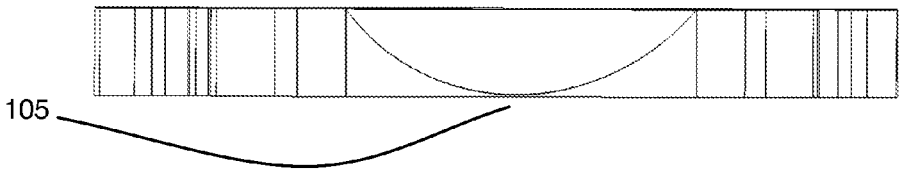
FIG. 5 illustrates a bottom view of an embodiment of the invention.

FIG. 5 illustrates a bottom view of an embodiment of the invention. Cutting edge 105 is shown pointing out of the page. As shown, the cutting edge curves inward and upward to the top face of the apparatus. Any other type of curved cutting edge may be utilized as desired and may include serrations if desired.

Figure 6:
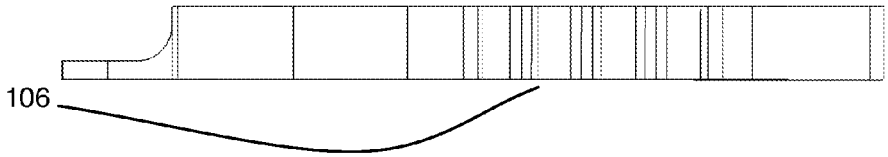
FIG. 6 illustrates a left side view of an embodiment of the invention.

FIG. 6 illustrates a left side view of an embodiment of the invention. Grip 106 is visible in this orientation. Although the grips are shown with equal spaced jimping, see the bottom left portion of FIG. 2 for variable sized jimping 106*a*, that for example may be utilized as wired strippers for different gauged wires.

Figure 7:
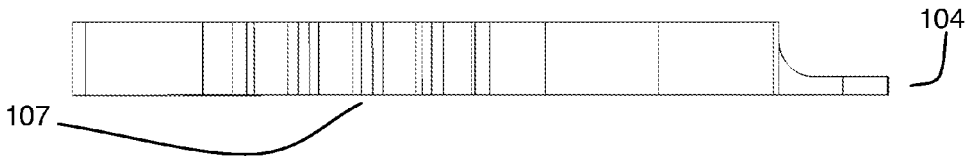
FIG. 7 illustrates a right side view of an embodiment of the invention.

FIG. 7 illustrates a right side view of an embodiment of the invention. The other grip, namely grip 107 is visible in this figure. Grip 107 may include other sized indentations with respect to the opposing grip 106. This allows for double the amount of wire gauges that may be stripped for example. In addition, spanner wrench 104 is implemented as an arch that travels from tool side 103 to two points that point to the right in the figure.

Figure 8:
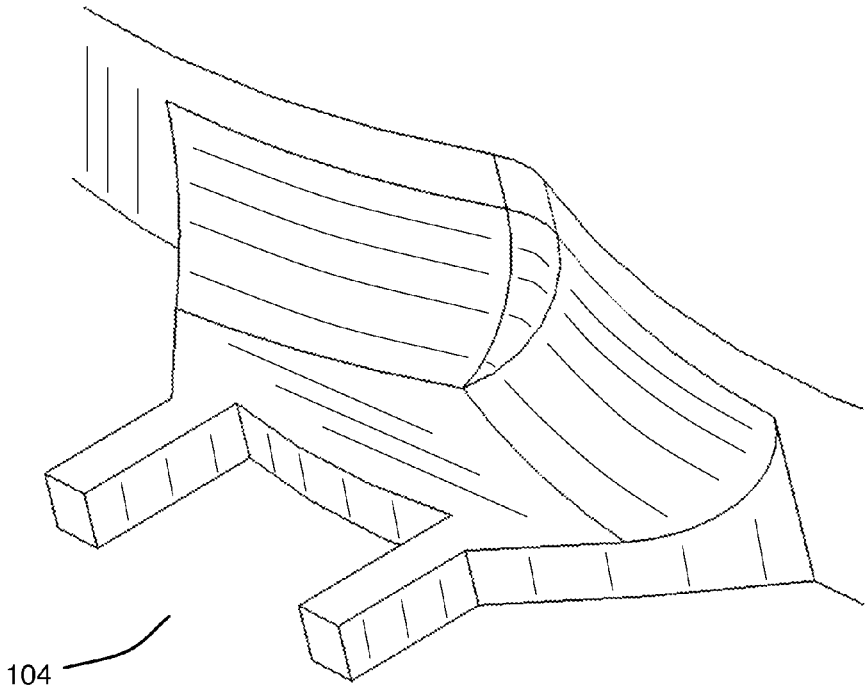
FIG. 8 illustrates a perspective close-up view of a top portion of an embodiment of the invention.

FIG. 8 illustrates a perspective close-up view of a top portion of an embodiment of the invention. As shown spanner wrench 104 includes two prongs that point to the left in the figure and are coupled with the tool body with an arching structure that may be implemented as shown or in any other manner so long as the two prongs may fit into corresponding holes of a spanner bolt head.

Figure 9:
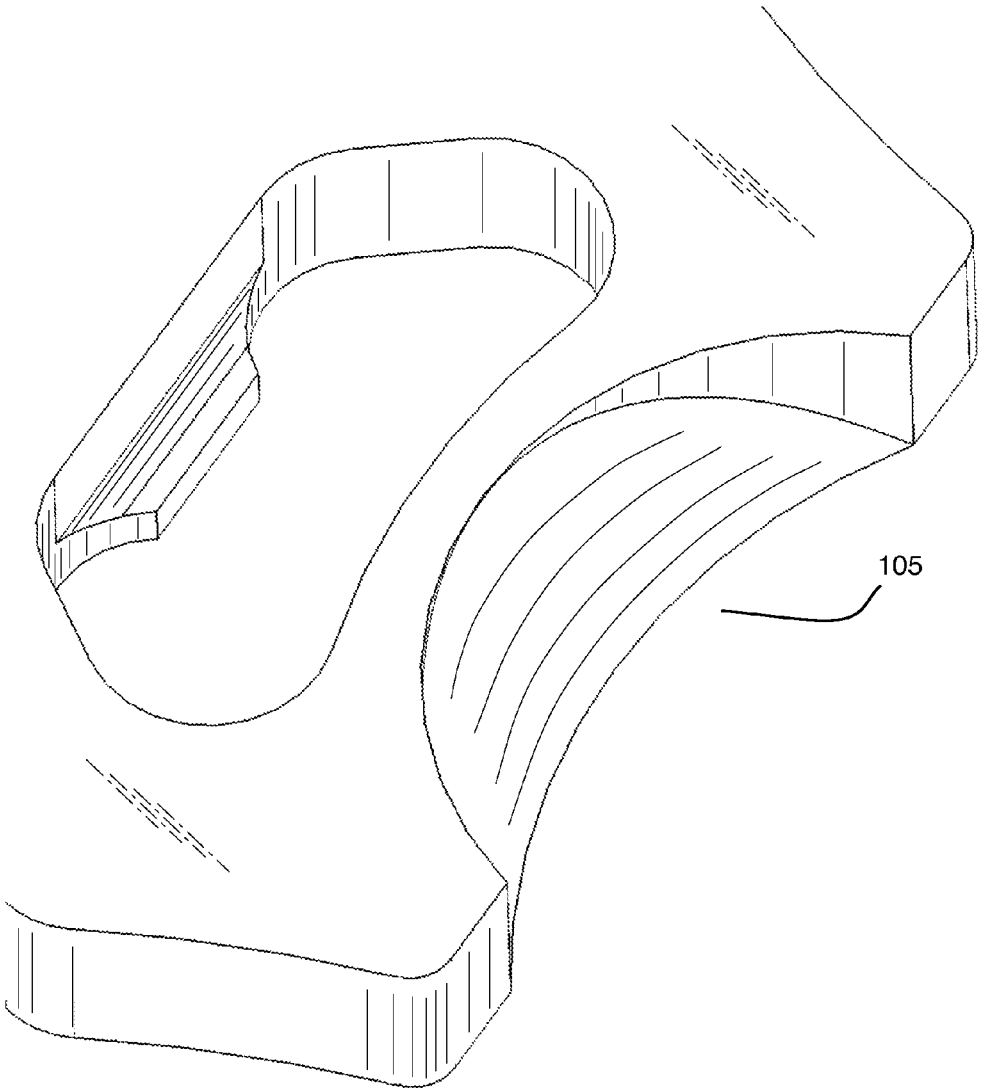
FIG. 9 illustrates a perspective close-up view of a bottom portion of an embodiment of the invention.

FIG. 9 illustrates a perspective close-up view of a bottom portion of an embodiment of the invention. As shown, cutting edge 105 is angled from the bottom face up and inward towards the top face. Although cutting edge 105 is shown as a curved cutting edge, this cutting edge may also be implemented as a straight cutting edge or in any other shape depending on the requirements for the implementation. In addition, the bottle cap engagement lip is shown within the bottle opener hole as a narrowing arched lip that extends from the inner wall of the hole towards cutting edge 105, and ending in a narrower portion that is relatively flat. This aids in catching the under portion of a bottle cap, but is not required. Any other structure may be utilized in implementing a bottle opener in other embodiments of the invention.

FIG. 10 illustrates a perspective view of a second embodiment of the invention. As shown, semi-circular indentation 111 with a straight section is shown on the right side of the figure. This area enables square or hexagonal standard sized nuts for example to be rotated by engaging the straight section with one side of the nut and rotating tool body 100 about an axis extending through the indentation. Also, accessory 150, here a glass breaker for another survival tool is shown coupled to the apparatus. The glass breaker may be made from any high strength material, for example carbon steel and may be formed in the shape of a pointed cone. In addition, curved cutting edge 105*a* may be utilized as a wire stripper for example. This is useful in demolition scenarios and other hazardous situations where no other tool may be at hand. In this embodiment, straight cutting edge 105 is also implemented on an edge of the tool that enables cutting while holding the grips of the tool to provide a secure grip.

Figure 11:
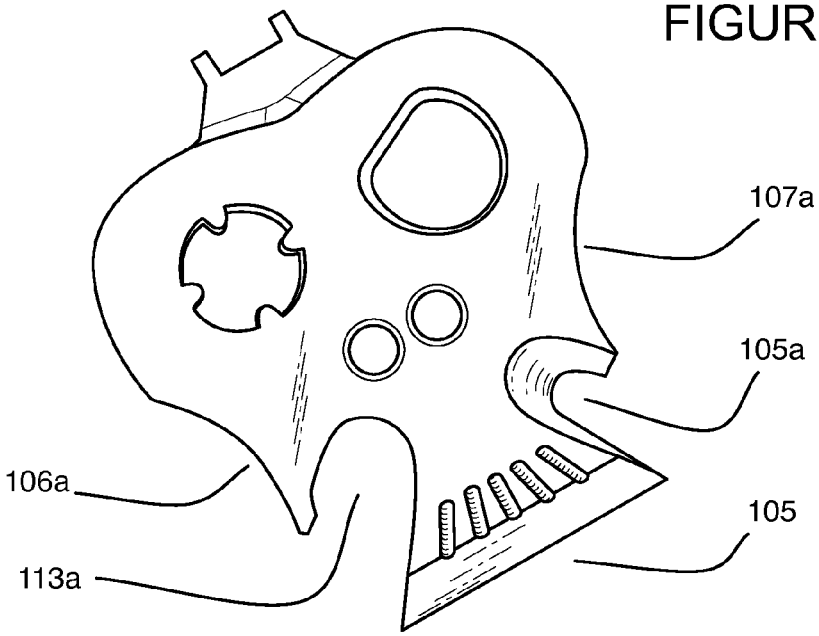
FIG. 11 illustrates a perspective view of a third embodiment of the invention.

FIG. 11 illustrates a perspective view of a third embodiment of the invention. As shown, grips 106*a* and 107*a* are flat, i.e., without jimping or knurling. In addition, bottle opener 113*a* is formed as a groove into tool body 100. This embodiment also employs two cutting edges, namely curved cutting edge 105*a* and straight cutting edge 105. Any combination of elements described herein may be utilized in as desired and based on the potential environment of use.

While the invention herein disclosed has been described by means of specific embodiments and applications thereof, numerous modifications and variations could be made thereto by those skilled in the art without departing from the scope of the invention set forth in the claims.

What is claimed is:

1. A compact survival tool comprising:

a tool body having a top face that is substantially flat, a bottom face that is substantially flat wherein said bottom face is on an opposite side of said tool body with respect to said top face, a tool side that couples said top face and said bottom face together;

wherein said tool side comprises a wrench, at least one cutting edge comprising a straight or curved cutting edge, a first grip and a second grip on opposite sides of said tool side;

wherein said first grip or said second grip or both said first grip and said second grip comprise jimping, and wherein said jimping on each of said first grip or said second grip or on each of both said first grip and said second grip, is configured as two or more indentations of different size configured to grip wire insulation of different gauge to enable translation movement of the tool body to remove the wire insulation;

wherein said tool body comprises a wrench indented into said top face of said tool body, at least one hole between said top face and said bottom face configured as lashing point.

2. The compact survival tool of claim 1 wherein said wrench in said tool side is configured as a spanner wrench.

3. The compact survival tool of claim 1 wherein said wrench in said tool body is configured as a castellated or slotted nut wrench.

4. The compact survival tool of claim 1 wherein said straight or curved cutting edge in said tool side extends at an angle inwardly from said bottom face to said top face along an edge of said tool side.

5. The compact survival tool of claim 1 wherein said tool body further comprises a semi-circular indentation with a straight section configured to engage a square or hexagonal nut on one edge thereof.

6. The compact survival tool of claim 1 wherein said at least one hole further comprises a hexagonal indentation that is configured to engage a hex nut to enable rotation of hex nut.

7. The compact survival tool of claim 1 wherein said at least one hole further comprises a hexagonal indentation that is configured to engage a hex nut to enable rotation of hex nut and wherein said at least one hole also comprises a threaded portion configured to engage a threaded element.

8. The compact survival tool of claim 1 wherein said tool body further comprises a bottle opener formed in said tool body as a hole in said tool body large enough to span a depth of a bottle cap and wherein said hole further comprises a bottle cap engagement lip in an inner portion of said hole.

9. The compact survival tool of claim 1 wherein said tool body further comprises a button compass port configured to couple with a button compass.

10. The compact survival tool of claim 1 wherein said tool side is at least 4 mm deep and wherein said top face and said bottom face do not exceed 50 mm in height or width.

11. A compact survival tool comprising:

a tool body having a top face that is substantially flat, a bottom face that is substantially flat wherein said bottom face is on an opposite side of said tool body with respect to said top face, a tool side that couples said top face and said bottom face together;

wherein said tool side comprises a spanner wrench, at least one cutting edge comprising a straight or curved cutting edge that extends at an angle inwardly from said bottom face to said top face along an edge of said tool side, a first grip and a second grip on opposite sides of said tool side wherein each of said first grip or said second grip or each of both said first grip and said second grip comprise jimping;

wherein said jimping is configured as two or more indentations of different size configured to one wire insulation of different au e to enable translation movement of the tool body to remove the wire insulation;

wherein said tool body comprises a castellated or slotted nut wrench indented into said top face of said tool body, at least one hole between said top face and said bottom face configured as lashing point, a semi-circular indentation with a straight section configured to engage a square or hexagonal nut on one edge thereof, a bottle opener formed in said tool body as a hole in said tool body large enough to span a depth of a bottle cap.

12. The compact survival tool of claim 11 wherein said at least one hole further comprises a hexagonal indentation that is configured to engage a hex nut to enable rotation of hex nut.

13. The compact survival tool of claim 11 wherein said at least one hole further comprises a hexagonal indentation that is configured to engage a hex nut to enable rotation of hex nut and wherein said at least one hole also comprises a threaded portion configured to engage a threaded element.

14. The compact survival tool of claim 11 wherein said bottle opener further comprises a bottle cap engagement lip in an inner portion of said hole.

15. The compact survival tool of claim 11 wherein said tool body further comprises a button compass port configured to couple with a button compass.

16. The compact survival tool of claim 11 wherein said tool side is at least 4 mm deep and wherein said top face and said bottom face do not exceed 50 mm in height or width.

17. A compact survival tool comprising:

a tool body having a top face that is substantially flat, a bottom face that is substantially flat wherein said bottom face is on an opposite side of said tool body with respect to said top face, a tool side that couples said top face and said bottom face together;

wherein said tool side comprises a spanner wrench, at least one cutting edge comprising a straight or curved cutting edge that extends at an angle inwardly from said bottom face to said top face along an edge of said tool side, a first grip and a second grip on opposite sides of said tool side wherein each of said first grip or said second grip or each of both said first grip and said second grip comprise jimping;

wherein said jimping is configured as two or more indentations of different size configured to one wire insulation of different gauge to enable translation movement of the tool body to remove the wire insulation;

wherein said tool body comprises a castellated or slotted nut wrench indented into said top face of said tool body, at least one hole between said top face and said bottom face configured as lashing point and wherein said at least one hole comprises a hexagonal indentation that is configured to engage a hex nut to enable rotation of hex nut or a semi-circular indentation with a straight section configured to engage a square or hexagonal nut on one edge thereof, a bottle opener formed in said tool body as a hole in said tool body large enough to span a depth of a bottle cap and wherein said hole optionally further comprises a bottle cap engagement lip in an inner portion of said hole, a button compass port configured to couple with a button compass.

18. The compact survival tool of claim 17 wherein said at least one hole further comprises a threaded portion configured to engage a threaded element.

19. The compact survival tool of claim 17 wherein said tool side is at least 4 mm deep and wherein said top face and said bottom face do not exceed 50 mm in height or width.

* * * * *